US009127842B2

(12) United States Patent
Böttcher et al.

(10) Patent No.: US 9,127,842 B2
(45) Date of Patent: Sep. 8, 2015

(54) BURNER, OPERATING METHOD AND ASSEMBLY METHOD

(75) Inventors: Andreas Böttcher, Ratingen (DE); Thomas Grieb, Krefeld (DE); Matthias Hase, Mülheim (DE); Peter Kaufmann, Moers (DE); Werner Krebs, Mülheim an der Ruhr (DE); Tobias Krieger, Duisburg (DE); Patrick Lapp, Berlin (DE); Mark F. Rubio, Orlando, FL (US); Udo Schmitz, Mülheim an der Ruhr (DE); Daniel Vogtmann, Monheim (DE); Ulrich Wörz, Mülheim Ruhr (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 820 days.

(21) Appl. No.: 12/472,729

(22) Filed: May 27, 2009

(65) Prior Publication Data

US 2010/0300104 A1 Dec. 2, 2010

(51) Int. Cl.
*F23R 3/28* (2006.01)
*F23R 3/34* (2006.01)

(52) U.S. Cl.
CPC ..... *F23R 3/283* (2013.01); *F23R 3/286* (2013.01); *F23R 3/343* (2013.01); *F23R 2900/00005* (2013.01); *F23R 2900/00012* (2013.01); *F23R 2900/00017* (2013.01);
(Continued)

(58) Field of Classification Search
CPC ..... F23R 3/14; F23R 3/28; F23R 3/283; F23R 3/286; F23R 3/34; F23R 3/343
USPC ..... 60/740–748, 796, 800
See application file for complete search history.

(56) References Cited

U.S. PATENT DOCUMENTS 3,735,930 A * 5/1973 Mori ..... 239/419.5
5,117,637 A 6/1992 Howell et al.

(Continued)

FOREIGN PATENT DOCUMENTS

EP 0469899 A1 2/1992
EP 1001224 A2 5/2000

(Continued)

OTHER PUBLICATIONS

International Search Report and Written Opinion of the International Searching Authority, Mar. 23, 2012, pp. 1-11.

*Primary Examiner* — Craig Kim

(57) ABSTRACT

A burner incorporating a pilot cone and a mounting insert is provided. The pilot cone is constructed as a pilot cone assembly which is decoupled from the mounting insert. Further, an operating method for increasing the service life of a burner which incorporates a pilot cone assembly and a mounting insert is provided. The pilot cone assembly has a cone side and incorporates at least one further side where the further side is arranged to be essentially parallel to one of the sides of the mounting insert and spaced apart from it, so that between the further side and the side of the mounting insert there is a defined gap. In an operation of the burner, the gap is significantly reduced by the thermal expansion in at least at one point of contact between the further side and the side of the mounting insert. Finally, an assembly method is provided.

8 Claims, 3 Drawing Sheets

(52) U.S. Cl.
CPC ... *F23R 2900/03282* (2013.01); *Y10T 29/4932* (2015.01); *Y10T 29/49323* (2015.01); *Y10T 29/49826* (2015.01)

(56) References Cited

U.S. PATENT DOCUMENTS

| | | | | | |
|---|---|---|---|---|---|
| 5,253,478 | A | * | 10/1993 | Thibault et al. | 60/733 |
| 5,671,597 | A | * | 9/1997 | Butler et al. | 60/796 |
| 6,327,861 | B2 | | 12/2001 | Sato et al. | |
| 6,530,227 | B1 | | 3/2003 | Young et al. | |
| 7,823,392 | B2 | | 11/2010 | Locatelli et al. | |
| 8,127,550 | B2 | | 3/2012 | Harris, Jr. et al. | |
| 2003/0000216 | A1 | * | 1/2003 | Akagi et al. | 60/746 |

FOREIGN PATENT DOCUMENTS

| | | | | |
|---|---|---|---|---|
| EP | 1258681 | A2 | | 11/2002 |
| EP | 1873458 | A1 | | 1/2008 |
| EP | 2256413 | A1 | * | 12/2010 |
| GB | 2134243 | A | | 8/1984 |
| RU | 2006119912 | A | | 12/2007 |
| WO | WO 2009005516 | A2 | | 1/2009 |

* cited by examiner

BURNER, OPERATING METHOD AND ASSEMBLY METHOD

FIELD OF INVENTION

The present invention relates to a burner, incorporating a pilot cone and a mounting insert. Further, the invention relates to an operating method for increasing the service life of a burner which incorporates a pilot cone and a mounting insert, in which the pilot cone has a cone side. In addition, the invention relates to an assembly procedure for assembling and disassembling an assembly consisting of a pilot cone with a pilot cone side.

BACKGROUND OF INVENTION

It is known that gas turbines contain the following components: a compressor, for compressing air; a combustion chamber for generating a hot gas by burning fuel in the presence of compressed air, which is produced by the compressor; and a turbine for the depressurization of the hot gas which has been generated in the combustion chamber. It is further known that gas turbines give off unwanted nitrogen oxide (NOx) and carbon monoxide (CO). One factor which is known to influence the emission of NOx is the combustion temperature. The scale of the NOx given off is reduced if the combustion temperature is lowered. However, higher combustion temperatures are desirable in order to achieve a higher efficiency and oxidation of the CO.

Two-stage combustion systems have been developed, which ensure efficient combustion and reduced emissions of NOx. In a two-stage combustion system, diffusion combustion is carried out in the first stage, to produce ignition and stability of the flame. In the second stage, combustion is effected using a premix, to reduce the emissions of NOx.

As shown in FIG. 1, a typical state of the art combustion chamber 10 incorporates an injector housing 6 which has a base 5 for the injector housing. An ignition injector 1 for diffusing the fuel, which has an injection hole 4 for the ignition fuel, passes through the injector housing 6 and is fixed to the base 5 of the injector housing. The main fuel injectors 2 run through the injector housing 6, parallel to the ignition injector 1, and are fixed to the base 5 of the injector housing. The fuel inlets 16 supply the main fuel injectors 2 with fuel. A main combustion zone 9 is formed within the outer cladding 19. A pilot cone 20 projects out from the vicinity of the injection hole 4 for the ignition fuel from the ignition injector 1, and has a flared end 22 adjacent to the main combustion zone 9. The pilot cone 20 has a linear profile 21 which forms a zone 23 for the ignition flame.

The compressed air 101 flows from the compressor 50 between supporting ribs 7 through the main fuel swirlers 8 into the main combustion zone 9. Each of the main fuel swirlers 8 provides numerous swirler vanes 80. The compressed air 12 is forced through a set of vanes 10, which are located within the ignition swirler 11, into the ignition flame zone. Within the pilot cone 20, the compressed air 12 mixes with the ignition fuel 30 and is transported into the ignition flame zone 23, where it burns.

Another burner system is the combustion system based on jet flames. By comparison with spin-stabilized systems, combustion systems based on jet flames offer advantages, in particular from a thermo-acoustic point of view, due to their distributed heat release zones and the lack of spin-induced swirling.

Jet flames are stabilized by mixing in hot recirculating gases. The recirculation zone temperatures necessary for this cannot be guaranteed in gas turbines, in particular in the lower partial-load range, by the known annular arrangement of the jets with a central recirculation zone. Here again, therefore, additional piloting is required, and again consists of a pilot burner and a pilot cone.

Here, the pilot cone is welded onto a mounting insert. Fuel or combustion air is fed to the combustion chamber through this mounting insert, for example by means of suitable passages. During operation, thermal expansions occur. These are the different thermal expansions of the various components, and also by the radial thermal expansion of the pilot cone. However, the permanent welded joint inhibits these thermal expansions, which leads to very high stresses on the cone itself. Due to the stresses occurring operation, the components are damaged, for example by cracking, and must as a result be replaced sooner. Hence the inhibiting of the thermal expansion leads to a reduction in the cyclic service life of the components, in particular the cone.

SUMMARY OF INVENTION

It is therefore the object of the present invention to specify a burner which has a longer service life. An object is also to specify a method for increasing the service life of a burner. In addition, another object of the invention is to specify an assembly method for a burner.

In respect of the burner, this object is achieved in accordance with the invention by the specification of a burner incorporating a pilot cone and a mounting insert, where the pilot cone is constructed as a pilot cone assembly which is decoupled from the mounting insert.

The invention is based on the consideration that the service life of the components, i.e. the pilot cone and the mounting insert, is significantly impaired by the inhibition of the thermal expansion of the components in the radial and axial directions, and the associated stresses which occur. Precisely this is now prevented with the aid of the invention, namely the construction of the pilot cone as an assembly and the decoupling of this assembly from the mounting insert. The decoupling of the two components leads to a longer service life for the pilot cone and to a reduction in the stresses.

Preferably, the decoupled pilot cone assembly will have a cone side and will incorporate, apart from the cone side, at least one further side. Here, the cone side is that side which is arranged in the combustion chamber itself and is directly exposed to the hot gas.

The decoupled pilot cone assembly will preferably also incorporate a seating side, which is arranged essentially axially to the direction of flow of the combustion gas.

In a preferred embodiment, the axial seating side has a screw fixing to the mounting insert. Preferably, the axial seating side will be essentially parallel to one of the sides of the mounting insert. This enables the pilot cone assembly to be fixed to the mounting insert. Here, the axial seating side has a side at the rear end, that is essentially at the rear end relative to the direction of flow for the mounting insert. Here, in particular, the temperature is lower. Here the compressor air is only at about 450-500° C. This means that the side of the mounting insert and also the axial mating side heat up and expand equally. Excessive heating of the axial seating side is also avoided. Stresses due to the screw fixing are thereby avoided. The service life of the pilot cone assembly is thereby significantly increased.

In a preferred embodiment, the at least one further side is essentially parallel to one of the sides of the mounting insert. A gap thus results between the mounting insert and the pilot cone assembly. This gap is then so calculated that at operating temperatures a gap is still formed between the front side of the cone, in the direction of flow, and the mounting insert, or the side of the cone which is lower relative to the direction of flow lands exactly on the mounting insert, in a radial direction. Here too, the gap can be purged by compressor air in order to avoid ignition of residual gas, for example, which can accumulate in the gap.

Preferably, the individual sides of the pilot cone assembly will be welded together. However, it is also conceivable that this pilot cone assembly is already formed in this shape during its manufacture. Other types of joint are also conceivable, such as for example soldering or creative forming.

The further side will preferably have a sealing ring, which is arranged between the further side and the mounting insert. The gap between the mounting insert and the pilot cone assembly is then closed off by means of the sealing ring. This makes it possible to avoid the purging of the gap by compressor air. Also, residual gas can no longer accumulate in the gap itself. If the gap is closed off by means of a sealing ring, it is then possible to reduce the length of both the further side and also the axial seating side. The welding of all the sides is no longer necessary. The pilot cone is thereby made lighter in weight, and material costs can be saved.

The sealing ring will preferably be a C-ring or a piston ring. This fulfills very well the sealing function and, if necessary, a defined leakage can be arranged, for example to effect purging.

A gas turbine will preferably be equipped with such a burner.

In respect of the method, this objective is, in accordance with the invention, by the specification of an operating method for increasing the service life of a burner, which incorporates a pilot cone assembly and a mounting insert, where the pilot cone assembly has a cone side, where the pilot cone assembly incorporates in addition to the cone side at least one further side, where this further side is arranged to be essentially parallel to and spaced away from one of the sides of the mounting insert, so that between the further side and the side of the mounting insert there is a defined gap, which in operation is significantly reduced, at least at one point of contact between the further side and the side of the mounting insert, by the thermal expansion.

In respect of the assembly method, this objective is achieved in accordance with the invention by the specification of an assembly method, for assembling and disassembling a pilot cone assembly with a pilot cone side, and of a mounting insert where the pilot cone assembly incorporates a cone side and in addition at least one axial seating side, where the axial seating side is parallel to a screw attachment side on the mounting insert, onto which it is bolted during assembly/disassembly. This simple screw fixing permits the pilot cone assembly to be simply and rapidly detached from the mounting insert. The fact that the pilot cone assembly is decoupled from the mounting insert prevents damage during assembly/disassembly.

BRIEF DESCRIPTION OF THE DRAWINGS

In what follows, an example of the invention is explained in more detail by reference to a drawing.

In this are shown, in a simplified form and not to scale.

In all the figures, parts which are the same have the same reference marks.

DETAILED DESCRIPTION OF INVENTION

Figure 2:
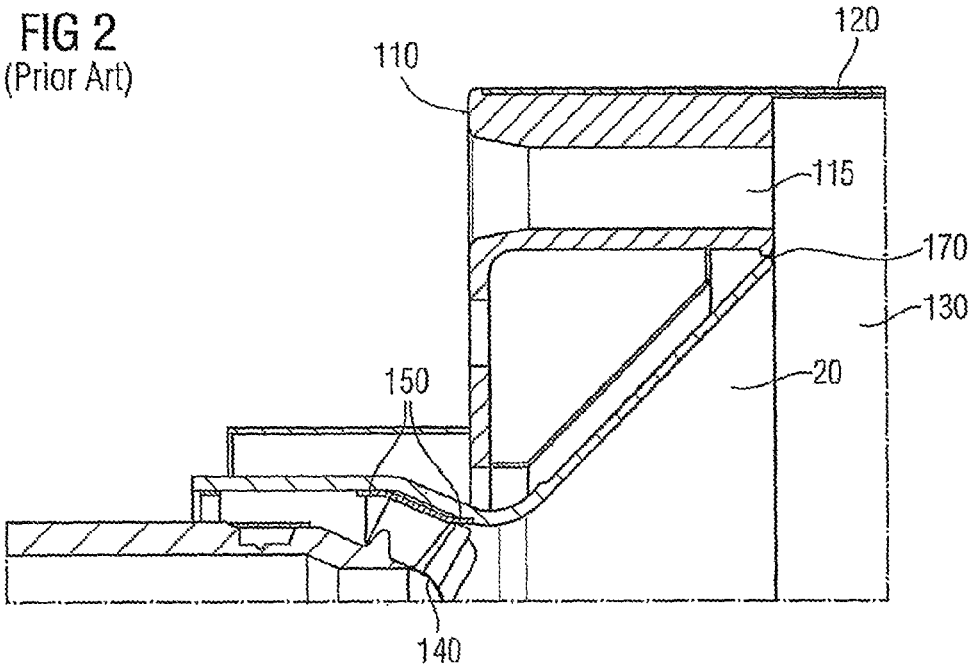
FIG 2 (Prior Art)

FIG. 2 shows a schematic representation of a burner with a pilot cone 20 according to the prior art. The pilot cone 20 is here welded onto a mounting insert 110 and serves as the interface between the pilot burner 140 and the mounting insert 110, which abuts the inner wall 120 of the combustion chamber. This has, among other features, through passages 115 which feed the combustion air to the combustion zone 130 of the combustion chamber. The outside of the pilot cone 20 is here welded onto the mounting insert 110, with at least one welded attachment point 170. The inside has a sliding fit 150 seated on the pilot burner 140 with. During operation however, thermally induced expansions arise, also inter alia in a radial direction. However, the welding and the sliding fit seating 150 greatly restrict this thermally-induced expansion. This produces strong, very high stresses on the cone 20. However, these thermal stresses lead to a reduction in the cyclic service life.

Figure 1:
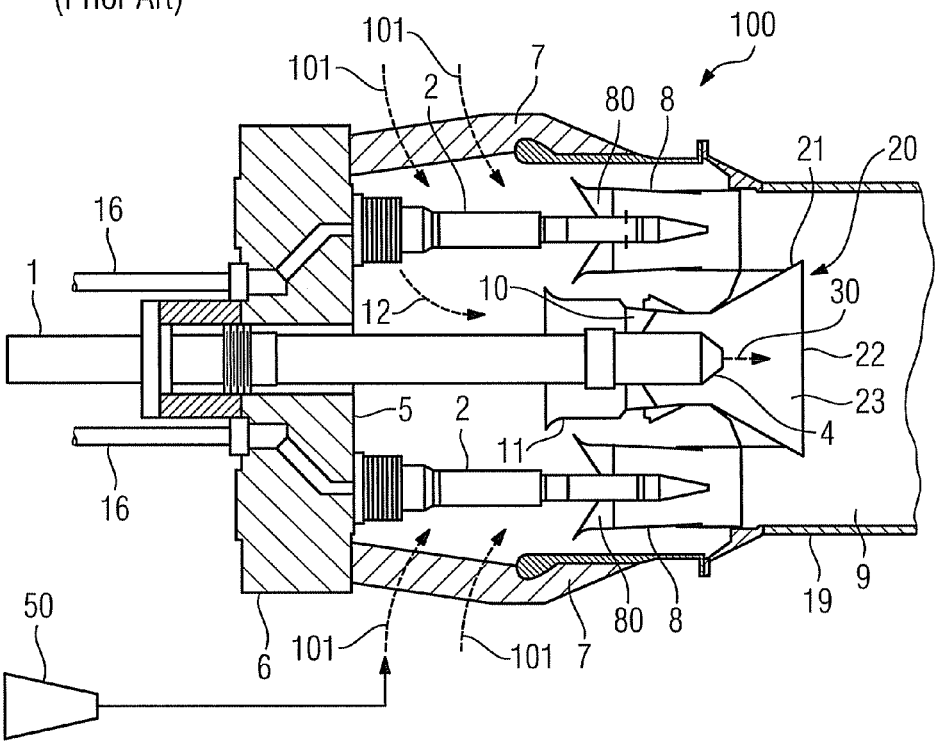
FIG 1 (Prior Art)
FIG. 1 a schematic drawing of a gas turbine with a burner in accordance with the prior art, FIG. 2 a schematic drawing of a burner with a pilot cone in accordance with the prior art, FIG. 3 a burner in accordance with the invention with a pilot cone assembly and mounting insert, FIG. 4 a section of a further exemplary embodiment of the burner in accordance with the invention, FIG. 5 an overall view of the additional exemplary embodiment.
Figure 3:
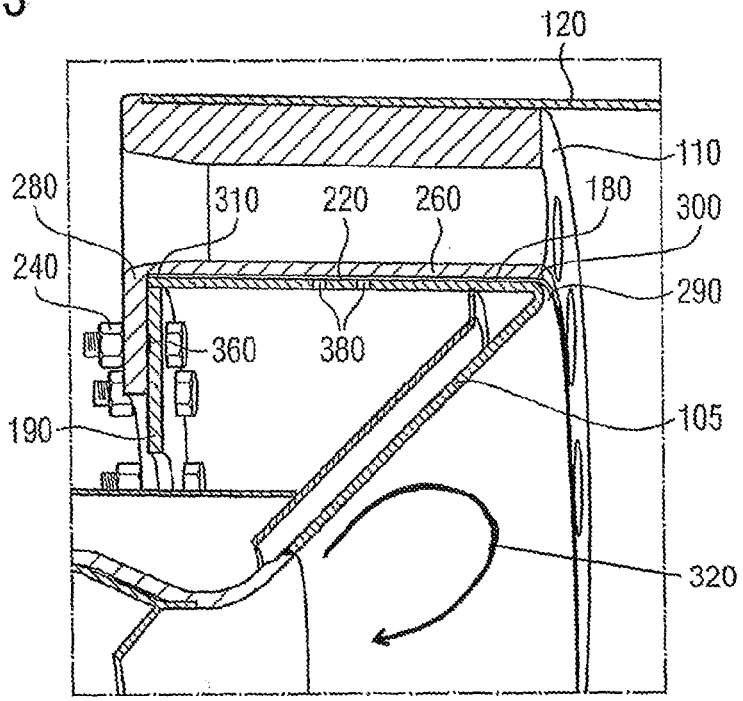

This is now avoided with the aid of the invention. FIG. 3 shows a burner in accordance with the invention, with a pilot cone assembly and mounting insert 110 in accordance with the invention. The burner in accordance with the invention has a pilot cone assembly, where this is constructed as an assembly which is decoupled from the mounting insert 110. The pilot cone comprises an internal recirculation circuit 320 that does not discharge directly in the combustion zone (see FIG. 1). The pilot cone assembly has accordingly a cone side 105. In accordance with the invention, the pilot cone assembly has in addition a further side 180. This is parallel to one of the sides of the mounting insert, preferably to the side which is parallel to the direction of flow. This is referred to below as the long side 260 of the mounting insert 110. The further side 180 and the long side 260 are spaced apart, so that they form a gap 220. In addition, the decoupled assembly also has a further axial seating side 190. This axial seating side 190 is also parallel to a side of the mounting insert 110, preferably that side which is perpendicular to the direction of flow. This side of the mounting insert 110 is referred to below as the screw attachment side 280. In summary, it can then be said that two sides of the decoupled assembly are parallel to two of the sides of the mounting insert 110. Here, all the sides of the assembly for the pilot cone can be welded together or otherwise permanently connected/joined to each other. The gap 220 permits a thermal expansion of the assembly and the mounting insert 110. The two assemblies are thus decoupled; in particular also thermally decoupled.

The decoupled assembly thus permits thermally induced expansion of the individual components, that is of the pilot cone assembly and also the mounting insert 110. Stresses on the components are thereby avoided, by which means the service life is lengthened.

The gap 220, which results between the essentially parallel and spaced-apart long side 260 and the further side 180 of the assembly is calculated to be defined such that, during operation, it is significantly narrowed or is closed up by thermal expansion at least at one point of contact 300, 310 between the further side 180 and the long side 260. Here, the gap 220 can be adjusted in such a way that—as with the weld point for a state of the art burner—the point of contact 300 between the further side 180 and the long side 260 lies essentially downstream. That is to say, after the operating temperature has been reached the gap 220 is closed up on the cone side 105 (here the front edge of the cone 290) and the long side 260. Here too, the gap 220 can have a through-flow of cooling or compressor air, so-called barrier air, to avoid a flashback. The point of contact 310 between the further side 180 and the long side 260 can also lie essentially upstream. The cone side 105, i.e. the front edge 290 of the cone, can then continue to form a gap 220 with the long side 260, even at operating temperature. After the operating temperature has been reached, the further side 180 lies radially against the long side 260, so to speak at the lower upstream end of the mounting insert 110.

In addition to the further side 180, the assembly also incorporates an axial seating side 190. This is essentially parallel to one side of the mounting insert 110, which is referred to in what follows as the screw attachment side 280. For the purpose of attaching the entire pilot cone assembly to the mounting insert 110, the axial seating side 190 is bolted to the screw attachment side 280 by a screw fixing 240. In this region, the compressor air has a temperature of only 450-500° C.; this represents a comparatively lower temperature than is the case, for example, in the combustion chamber. As the temperatures here are lower, the cone assembly and the mounting insert 110 expand equally in this region. This has the advantage that the stresses which can now arise even with the inventive screw fixing 240, for example due to inhibition of the thermal expansion of the components, are now significantly reduced both in the case of the mounting insert 110 and also for the pilot cone assembly, which also lengthens the service life of both components. In addition, a significantly simpler assembly/disassembly of the pilot cone assembly and also of the mounting insert 110 is possible, because these are no longer joined to each other by welding, but represent in each case a decoupled component. It is also possible to provide an axial seal 360 between the axial seating side 190 and the screw attachment side 280, that is to say on the so-called cold side of the burner. Since the two sides there are only dependent on the prewarming of the air, and not on the heat transfer on the hot gas side, the thermal expansion is then equal for both sides. As a result, the proposed axial seal 360 is therefore tight to engineering standards. In addition, or alternatively, a leakage bore hole 380 can also be provided. This can consist, for example, of one or more bore holes. If the gap 220 is cooled with barrier air, the leakage bore hole 380 permits precise adjustment of this barrier air. This has the advantage that the air is uniformly distributed around the perimeter. In addition, it has the advantage that unwanted effects on the flame stability or the combustion regime, due to excessive or undistributed barrier air, are avoided. The barrier air can thus be precisely adjusted using the leakage bore hole 380. Higher emissions can thereby be avoided.

Figure 4:
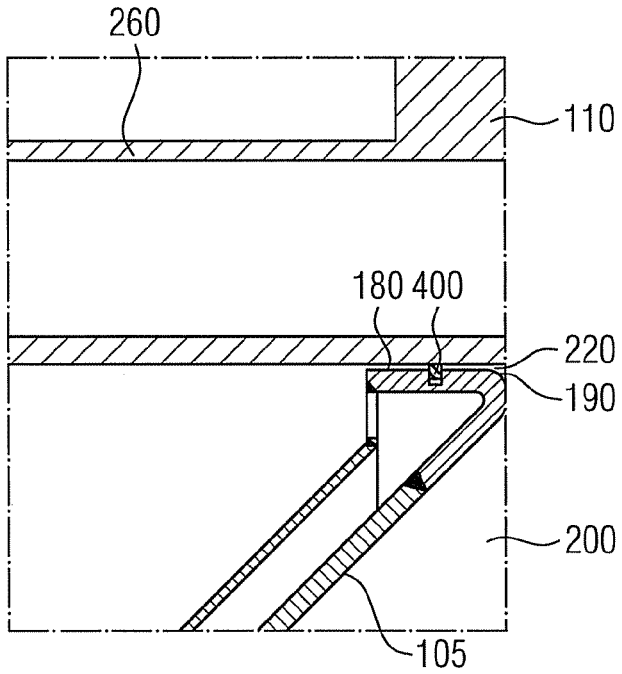
Figure 5:
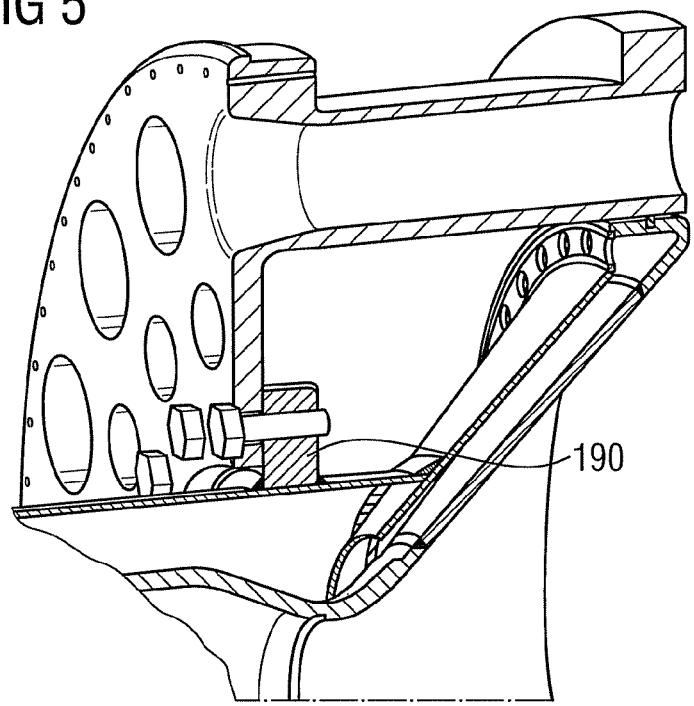

FIG. 4 now shows a further exemplary embodiment of the invention. In this, the length of the further side 180 of the pilot cone assembly is greatly reduced. Between the further side 180 and the long side 260 of the mounting insert 110 there is now a sealing ring 400. This significantly reduces the gap size for the gap 220 between the mounting insert 110 and the pilot cone assembly, or completely closes up the gap 220. A possible occurrence of flashback is thereby prevented. In addition the gap 220 need no longer have a through flow of barrier air, or only very little. The sealing ring 400 can here be made as a piston ring or C-ring. These are particularly suitable because they fulfill the sealing function very well. If the gap 220 continues to have a slight through flow of cooling air, then the piston ring or equally the C-ring can be adjusted for a defined leakage. In this exemplary embodiment, the axial seating side 190 is also greatly shortened (FIG. 5). For the purpose of attaching the entire pilot cone assembly to the mounting insert 110, the axial seating side 190 is bolted to the screw attachment side 280 by a screw fixing 240. An advantage of the shortening of the axial seating side 190 and the further side 180 is a lower weight. In addition, material costs can thereby be saved. Here again, however, simple detachment of the pilot cone assembly is possible, in that only the screw fixing needs to be undone.

The method in accordance with the invention and also the inventive burner with a decoupled pilot cone assembly and mounting insert 110 thus make it possible significantly to reduce the stresses on the two components. The inventive pilot cone assembly and mounting insert 110 exhibit a higher service life. The improved assembly method increases the assembly/disassembly of the pilot cone assembly and also of the mounting insert 110. The actual decoupling between the pilot cone assembly and the mounting insert 110 also contributes to improved assembly/disassembly of the two components.

The invention claimed is:

1. A burner, comprising:

a stabilizing fuel stage comprising a pilot cone passing a stabilizing fuel to a combustion zone, a mounting insert comprising a series of passages disposed for passing combustion air to the combustion zone, wherein the pilot cone comprises an internal recirculation circuit that does not discharge directly into the combustion zone, wherein the pilot cone is incorporated together with the mounting insert, wherein the pilot cone is constructed as a pilot cone assembly comprising a cone side directly exposed to hot gas during operation of the burner and a further side connecting to the cone side at a downstream face of the mounting insert and being parallel to a side of the mounting insert, wherein the pilot cone assembly is decoupled from the mounting insert, wherein the pilot cone does not extend beyond a downstream face of the mounting insert, wherein the pilot cone assembly comprises an axial seating side, and the mounting insert comprises a screw attachment side, the axial seating side bolted to the screw attachment side by a screw fixing so that the pilot cone assembly is detachably coupled to the mounting insert.

2. The burner as claimed in claim 1, wherein the axial seating side is essentially parallel to the screw attachment side which is a side of the mounting insert.

3. The burner as claimed in claim 1, wherein the further side is essentially parallel to one of the plurality of sides of the mounting insert.

4. The burner as claimed in claim 1, wherein the plurality of individual sides of the pilot cone assembly are welded together.

5. The burner as claimed in claim 1, wherein the further side has a sealing ring, the sealing ring is arranged between the further side and the mounting insert.

6. The burner as claimed in claim 5, wherein the sealing ring is a C-ring or a piston ring.

7. A gas turbine with a burner as claimed in claim 1.

8. The burner as claimed in claim 1, wherein an axial seal is attached between the axial seating side and the screw attachment side.

* * * * *